United States Patent [19]

Zingl

[11] Patent Number: 4,539,893

[45] Date of Patent: Sep. 10, 1985

[54] POWER FEED SYSTEM FOR A ROTARY DRILL

[75] Inventor: Hans Zingl, Allentown, Pa.

[73] Assignee: Ingersoll-Rand Company, Woodcliff Lake, N.J.

[21] Appl. No.: 613,363

[22] Filed: May 23, 1984

[51] Int. Cl.[3] ..... F01B 15/02

[52] U.S. Cl. ..... 92/52; 92/110; 92/117 A

[58] Field of Search ..... 92/117 R, 117 A, 51, 92/52, 110, 111; 91/216 R, 216 A, 216 B

[56] References Cited

U.S. PATENT DOCUMENTS

| | | | |
|---|---|---|---|
| 769,106 | 8/1904 | McCarthy | 92/117 A |
| 2,804,051 | 8/1957 | Lushonsky, Jr. | 92/117 A |
| 2,922,398 | 1/1960 | Lindsey | 91/216 R |

*Primary Examiner*—Paul E. Maslousky

*Attorney, Agent, or Firm*—R. J. Falkowski

[57] ABSTRACT

Disclosed herein is a power feed system for translating a rotary drill head along the length of a guide tower. The system utilizes a compound balanced area, end fed hydraulic cylinder as the actuating means. This arrangement provides a large ratio of fixed overall length to usable travel distance, balanced feed force in both directions, direct connection of the rotary head to the outer stage of the cylinder, and drift-free operation, all without the need for moving hydraulic hoses.

4 Claims, 4 Drawing Figures

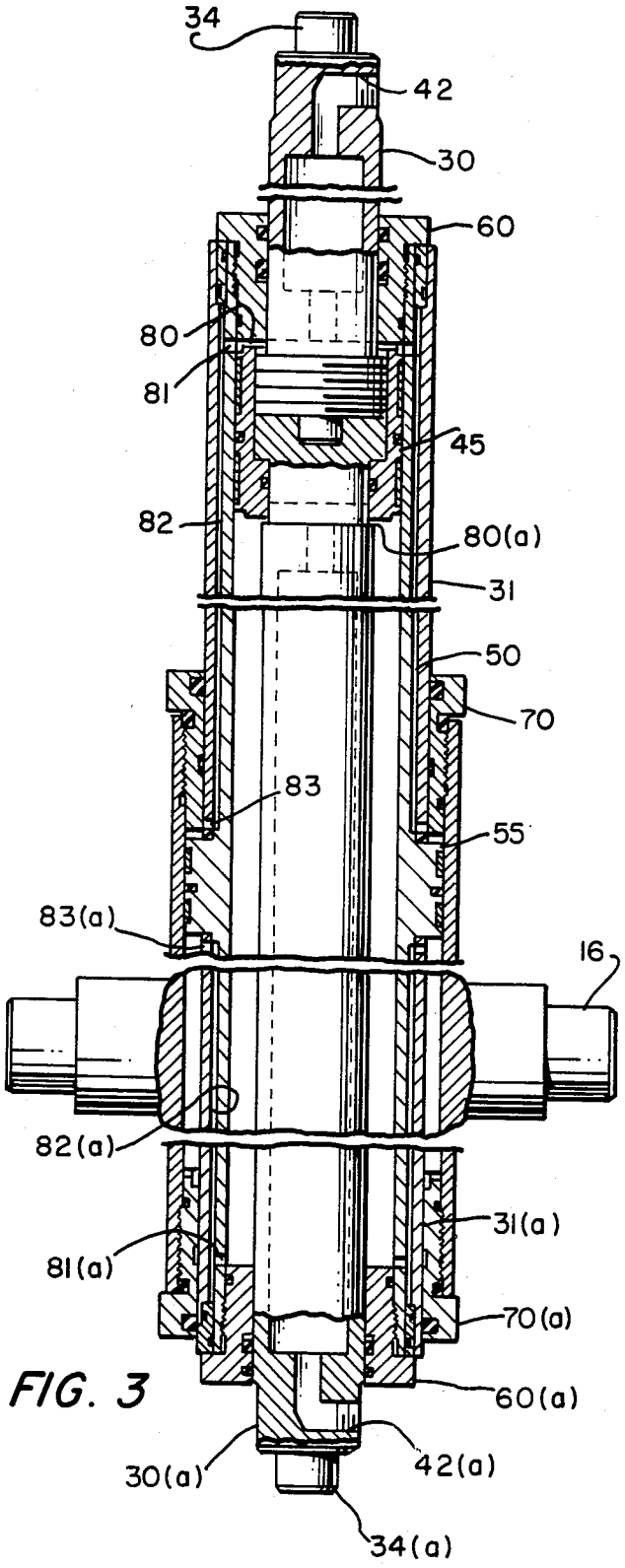
FIG. 3
FIG. 1A
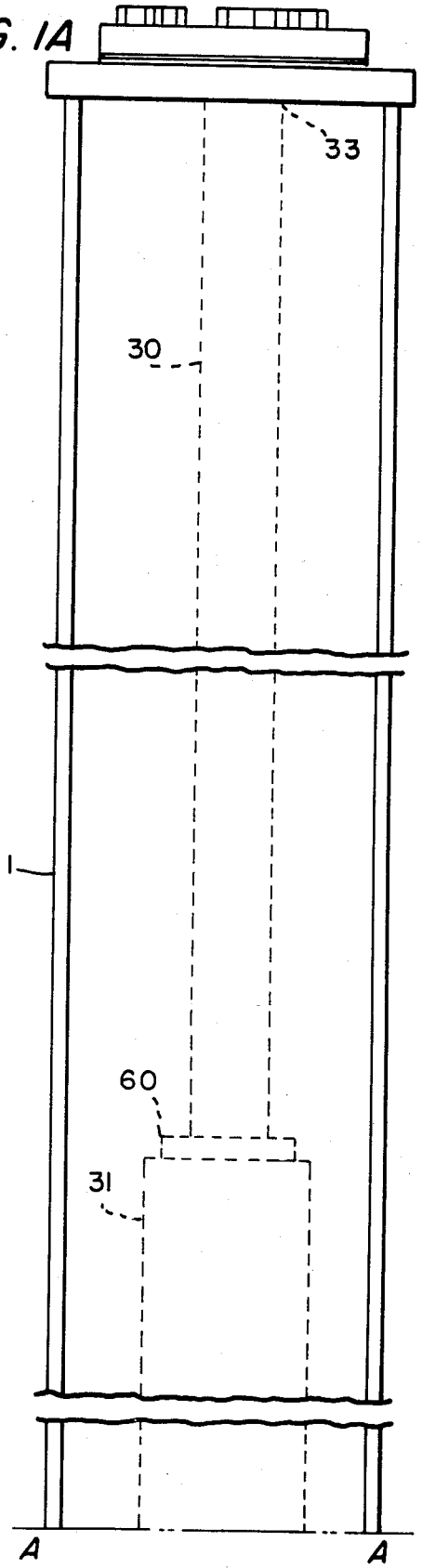

POWER FEED SYSTEM FOR A ROTARY DRILL

FIELD OF THE INVENTION

The present invention relates to devices for advancing a rotary power head or the like on a guide such as is commonly utilized in rotary earth boring.

BACKGROUND OF THE INVENTION

In the past many schemes have been tried to accomplish the linear translation of rotary head devices along a guide. Such attempts have included the use of chain or cable drives powered by hydraulic cylinders, hydraulic motors, air motors, and the like. These systems have utilized and depended upon the integrity of chains and cables for operation and suffered their attendant, and high cost of maintenance.

In the case of a cable or chain failure, the rotary head mounted for vertical movement on a tower could descend rapidly, thereby creating the possibility of serious injury. Several direct coupled hydraulic cylinders schemes have been tried including the use of piggy-backed hydraulic cylinders. All of these attempts in the past have required the use of traveling hydraulic hoses which are subject to damage and/or severally restricted the available travel.

BRIEF SUMMARY OF THE INVENTION

The present invention teaches the use of an end fed, balanced, multiple-stage hydraulic cylinder which is secured to the guide frame by its rod ends and is also fed at its rod ends, thereby eliminating the need for hydraulic hoses. The balanced multiple-staging provides a high-usuable length in comparison to the overall length of the guide and further permits equal feed and retracting forces. The equal hydraulic displacement in both directions further provide a simplified means of locking the cylinder and also selection of the direction of force application.

The object of the invention, therefor, is to provide a simple, reliable, safe, and easy-to-utilize method for translating a rotary drill head or the like along a guide means or tower.

Primary objects include elimination of traveling hoses, and simple hydraulic valving to affect reversal and/or the locking of the cylinder.

Yet, a further object of the invention is to provide a safe, effective means for translating the rotary drill head wherein the failure of hydraulic supply will not result in catastrophic collapse of the rotary head such as may occur with the failure of a suspending cable or chain.

These and other objects are obtained in a power feed system for rotary drills comprising: a power feed system for translating a carriage along the length of a tower assembly comprising: carriage means attached to a tower means for longitudinal translation relative thereto; compound hydraulic cylinder means having rod ends fixed to both the top and bottom portion of the tower means; the cylinder means further having an external barrel connected to the carriage means for imparting movement to the carriage means; and hydraulic pressure fluid supply means at each of the fixed rod ends.

BRIEF DESCRIPTION OF THE DRAWINGS

FIG. 1(A) show the top half of the tower mating with FIG. 1 at parting line (AA).

FIG. 3 is a cross-sectional elevation detail of the unique hydraulic cylinder utilized to linearly transport the drill head along the tower.

DETAILED DESCRIPTION OF THE PREFERRED EMBODIMENT

Figure 1:
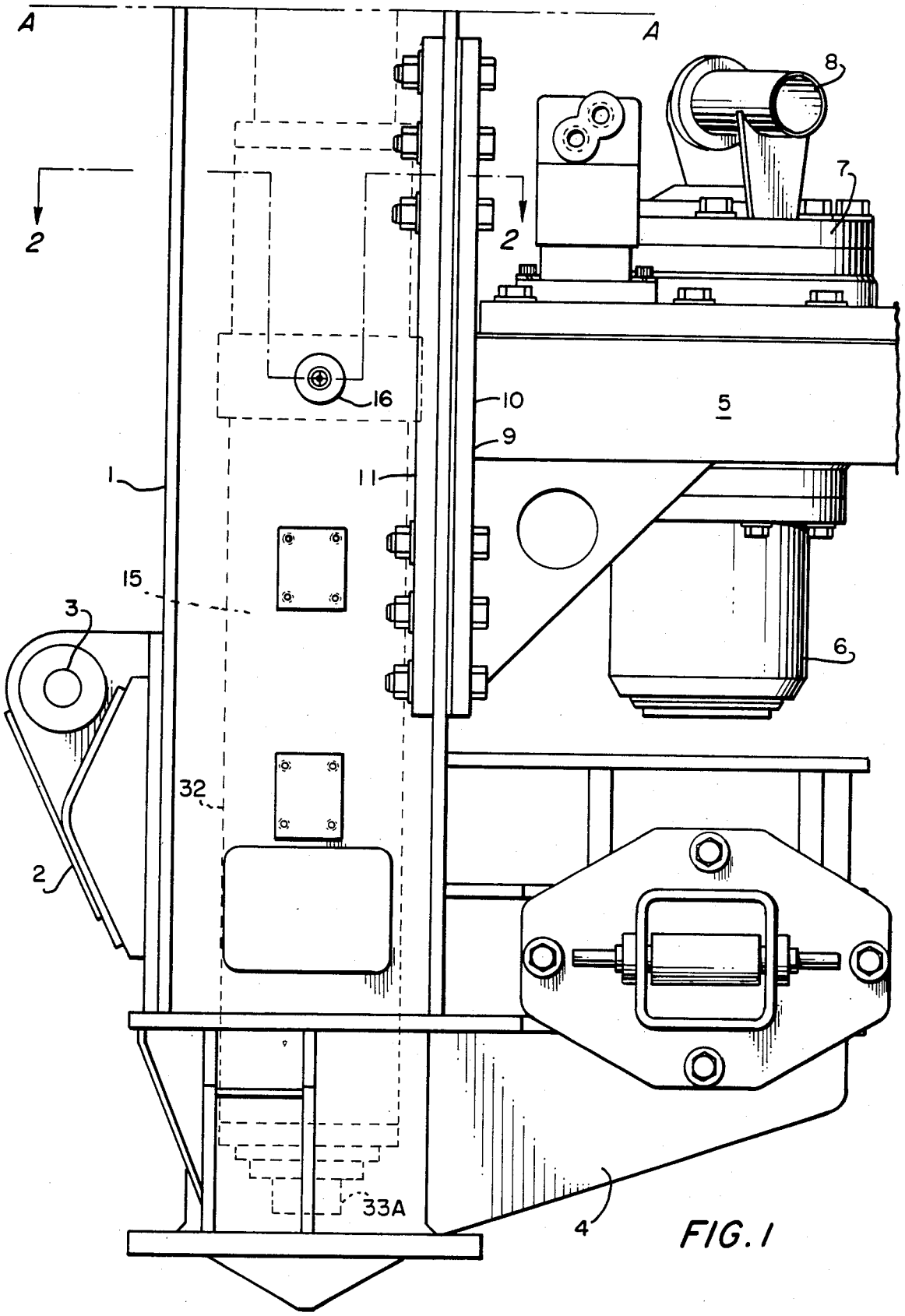
FIG. 1 is an elevation view of the bottom half of the tower assembly for a rock drilling rig showing details of the tower mounts and the rotary drill head and the centralizer mounted on the tower.

Referring to FIG. 1, a drilling rig tower, generally identified by reference numeral 1 is shown. Such towers are commonly constructed of welded and bolted structural shapes. The tower is utilized to support the drilling head and as a support and guide for drill rods. The tower is supported on a base commonly a crawler or tractor base (not shown).

The tower support bracket 2 is shown provided with a support pin 3 which is connected to the support structure and allows the tower to be tilted at various angles. The tilting mechanism is well known and not shown in the present drawings. A centralizing mechanism 4 is shown attached to the tower at its lower end. The function of the centralizer is to provide lower support and guides for the drill rod.

Also shown mounted on the tower in sliding relationship thereto is a carriage 5 which supports the rotary drill head 6 and its associated drive motor 7. Air for the drive motor 7 is introduced through air inlet 8. The carriage 5 is mounted to the tower by means of guide 10. Guide 10 is comprised of a bolted assembly consisting of the carriage 5, carriage plate 9, and opposed shoe 11 which grips the tower's structural members in sliding relationship through slide bearing 20. The construction of these guides is well known and not further described here. It is sufficient for purpose of the present description to understand that carriage 5 is free to slide longitudinally along the tower and the carriage is guided in that movement by means of the carriage guide 10 which permits movement only longitudinally along the tower.

In operation the carriage is moved to an upper position on the tower and a drill rod (not shown) is inserted between the rotary head and the centralizer through which the drill rod passes. The drill rod is rotated by the rotary head and it is forced into the rock formation through the centralizer by a power feed means which creates downward pressure on the carriage and thereby forces the drill rod into the rock formation.

Air is commonly used to both rotate the drill head and thereby the drill rod and also as a means of cleaning a drilled hole. Such air may be provided through air inlet 8 (shown).

The present invention involves a new and novel method of transporting the rotary drill head and its carriage along the drill tower. To accomplish this, a unique end fed, two-stage hydraulic cylinder 15 is employed. The cylinder is shown mounted within the tower structure with the rod ends 33 and 33(*a*) securely attached to the top and bottom of the tower structure.

FIG. 1(A) is a continuation of FIG. 1 (top of the tower joined at common intersection line AA). With rod ends 33 and 33A secured to the ends of the tower, the cylinder rods 30 and 30(*a*) are likewise secured from movement in the tower structure. Intermediate stage 31 is free to traverse longitudinally along cylinder rods 30 and 30(*a*) and barrel 32 is free to traverse longitudinally along the intermediate stage and both are activated to do so by hydraulic fluid introduced at the rod ends 33 and 33A as will be more fully described later.

Figure 2:
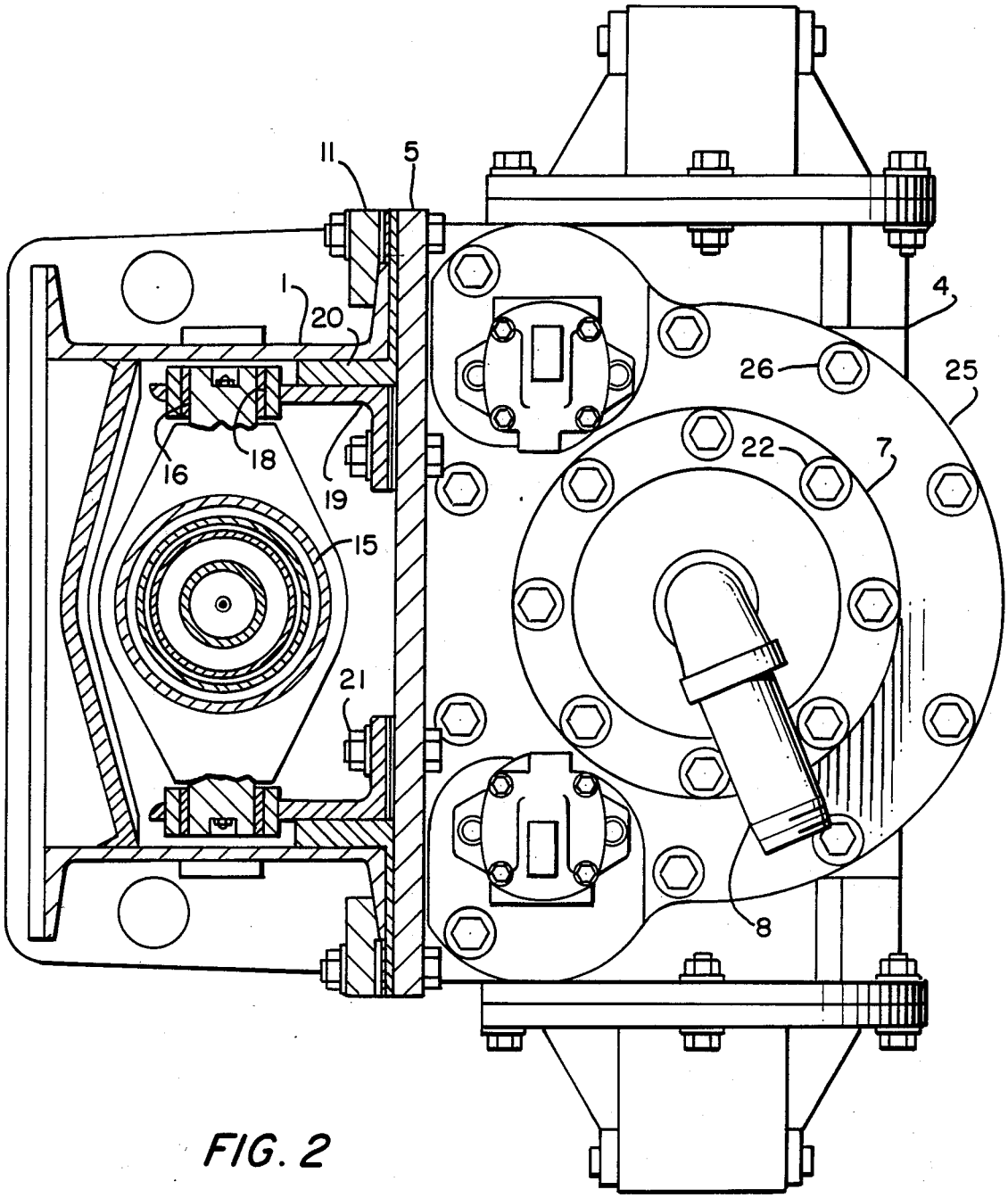
FIG. 2 is a plan view partially sectioned along section line 2—2 of the tower as viewed from the top of the tower showing further details of the rotary drill head mounting on the tower.

Cylinder barrel 32 is provided with a pair of trunnions 16 which project radially out from the cylinder barrel and provide a means for connecting the cylinder to the carriages. The connection is best seen in FIG. 2 wherein the trunnions 16 are shown coacting with a trunnion bearing 18 which is mounted on a trunnion bracket 19. Trunnion bracket 19 in turn is secured to the carriage plate 9 by means of mounting bolts 21.

It should now be appreciated by one skilled in the art that movement of the cylinder barrel 32 in the axial direction along the tower will likewise move the carriage plate and hence the carriage 5 along the tower.

FIG. 2 shows the relative position of the cylinder within the tower structure and the carriage and further details the guide structure 10 including the shoe 11 and slide bearing 20. Also, in FIG. 2 is a partial view of the centralizer mechanism 4, the drive motor 7 and the motor mounting plate 25. Motor bolts 22 retain the top head of the motor and the mounting plate bolts 26 secure the motor rotary head assembly to the carriage 5.

Referring now to FIG. 3 which shows the unique construction of the power feed cylinder. The cylinder is comprised of three primary parts. The first is the cylinder rod assembly which is comprised of two hollow rods 30 and 30(*a*). The ends of each hollow rod portion are provided with a mounting stud 34 and 34(*a*) and a pressure fluid inlet 42 and 42(*a*) respectively. The upper and the lower rod hollow rod 30 and 30(*a*) are joined together at the cylinder rod piston 45. The cylinder rod piston 45 is in sliding and sealing engagement with the second primary part, intermediate stage 50. Intermediate stage 50 is provided with an enlarged diameter, intermediate stage piston portion 55 serving as a piston in cylinder barrel 32, the third primary part, and slides in sealing relationship relative thereto.

At each end of the intermediate stage 50, the primary sleeves are in centric relationship to the intermediate stage 50 and surrounds it at each end. Sleeve for the upper portion is designated as sleeve 31. The sleeve for the lower portion is designated as sleeve 31(*a*). A cylinder head is provided for each stage at each end. The rod cylinder head between the cylinder rod and the intermediate stage 50 for the upper portion of the cylinder is designated as reference numeral 60. For the lower portion it is designated as 60(*a*). The intermediate stage cylinder head between the intermediate stage 50 and the barrel 32 is designated by the reference numeral 70 for the upper portion of the cylinder and 70(*a*) for the lower portion of the cylinder.

It should be understood by one skilled in the art that cylinder rods 30 and 30(*a*) are slidingly engaged in cylinder heads 60 and 60(*a*) respectively and sealed against hydraulic leakage by appropriate sealing means (seals shown) and that further the intermediate stage sleeves 31 and 31(*a*) are in sliding engagement with the intermediate stage cylinder heads 70 and 70(*a*) and sealed against hydraulic leakage by appropriate sealing means (seals shown).

It should be further understood that the effective area of the cylinder rod piston is equal on both sides of the piston. The area on both sides of the intermediate stage piston 55 is also equal. This provides a symetrical structure end-for-end and a piston which produces equal force in both directions for a given hydraulic pressure.

Referring again to FIG. 3, it should be obvious to one skilled in the art that hydraulic pressure fluid introduced at pressure fluid inlet 42 will pass through the center of cylinder rod 30 to the upper surface of cylinder rod piston 45 and simultaneously by means of cross ports 80 and 81, annular space 82 and cross port 83 to the upper surface of intermediate piston 55. Similar porting is also provided for the lower portion of the piston and designated with the corresponding appropriate reference number with an (a) suffix.

The functions of the various seals shown should be well understood by the person skilled in the art of hydraulic cylinder manufacture. In operation, it should be now understood that hydraulic fluid introduced in pressure fluid inlet port 42 will pressurize the upper piston surfaces of cylinder rod piston 45 and intermediate stage piston 55. This in turn will cause the intermediate stage to move upwards along the rod and further cause the barrel to rise upwards along the intermediate stage. This results in the rotary head being lifted by the trunnions and associated support brackets 19. Likewise, pressure fluid introduced in the pressure fluid inlet 42(*a*) will cause the rotary head to be forced downward towards the centralizer.

It should also be recognized by one skilled in the art that a simple valving may be utilized to select the direction of hydraulic fluid flow to either the upper or the lower pressure fluid inlet 42 or 42(*a*) and thereby select the movement of the rotary head.

It should further be understood that blocking the fluid flow will lock the rotary head in a fixed position. In addition, if the pressure fluid supply to inlet 42 is connected to pressure fluid inlet 42(*a*) rather than the source of hydraulic fluid, a condition of free float will exist in the cylinder and the rotary head may be moved against the flow of hydraulic fluid. This permits the operator to move the head without the application of hydraulic fluid pressure in emergency situations or where a free carriage situation is required in normal operation or for rod alignment.

Having described my invention in terms of a preferred embodiment minimizes modification and variation will occur to those skilled in the art and I do not wish to be limited in the scope of my invention except as claimed.

I claim:

1. A power feed system for translating a carriage along the length of a tower assembly comprising:

carriage means attached to a tower means for longitudinal translation relative thereto;

a compound hydraulic cylinder means having rod ends fixed to both the top and bottom portion of said tower means, and a first and second hollow cylinder rod;

said first hollow cylinder rod being attached to said tower at the top and said second hollow cylinder rod being attached to said tower at the bottom;

said first cylinder rod and said second cylinder rod being joined to a common piston;

said first cylinder rod and said second cylinder rod further being supplied with hydraulic pressure fluid at each end attached to the tower;

said hydraulic cylinder means being further provided with an intermediate stage receiving hydraulic fluid from said cylinder rods and a final stage including an external cylinder barrel which traverses along said intermediate stage and said cylinder rods from one end of said tower to the other end of said tower;

said external barrel being connected to said carriage means for imparting movement to said carriage means; and hydraulic pressure fluid supply means introduced at each of the fixed rod ends for operating said cylinder means.

2. A power feed system according to claim 1 wherein said carriage means includes guide means for accurately guiding said carriage means for longitudinal translation along the length of said tower means.

3. A power feed system according to claim 1 wherein said external barrel is directly attached to said carriage means and moves with said carriage means from one tower end to the other end of said tower.

4. A power feed system according to claim 1 wherein hydraulic fluid is piped directly to the ends of each cylinder rod thereby eliminating traveling hoses.

* * * * *